US011529023B1

(12) United States Patent
Moroles

(10) Patent No.: US 11,529,023 B1
(45) Date of Patent: Dec. 20, 2022

(54) EASY TO CLEAN SHOWER AND COMMODE CHAIR

(71) Applicant: Gilbert Moroles, Mc Allen, TX (US)

(72) Inventor: Gilbert Moroles, Mc Allen, TX (US)

( * ) Notice: Subject to any disclaimer, the term of this patent is extended or adjusted under 35 U.S.C. 154(b) by 38 days.

(21) Appl. No.: 16/715,312

(22) Filed: Dec. 16, 2019

Related U.S. Application Data

(60) Provisional application No. 62/782,082, filed on Dec. 19, 2018.

(51) Int. Cl.
*A47K 3/12* (2006.01)
*A47K 3/28* (2006.01)
*A61Q 17/00* (2006.01)

(52) U.S. Cl.
CPC ..... *A47K 3/282* (2013.01); *A61Q 17/005* (2013.01); *A47K 3/122* (2013.01)

(58) Field of Classification Search
CPC ..... A47K 3/282; A47K 3/12; A47K 3/122; A47K 3/125; A47K 11/04; A61Q 17/005
USPC ..... 4/571.1, 573.1, 577.1, 578.1
See application file for complete search history.

(56) References Cited

U.S. PATENT DOCUMENTS 7,213,276 B2 * 5/2007 Palma ..... A47K 3/12 4/573.1
8,978,173 B1 * 3/2015 Lederer ..... A47K 11/04 4/434
10,813,506 B1 * 10/2020 Mitrano ..... A47K 3/282
2006/0143816 A1 * 7/2006 Su ..... A47K 11/04 4/483
2007/0074338 A1 * 4/2007 List ..... A47K 11/04 4/483
2008/0034494 A1 * 2/2008 Monteiro ..... A47K 3/122 4/560.1
2010/0175178 A1 * 7/2010 Mrugala ..... A47K 11/06 4/483
2014/0084019 A1 * 3/2014 Cotey ..... A61G 1/01 221/33
2015/0208884 A1 * 7/2015 Oluwasogo ..... A47K 11/04 4/483
2016/0000279 A1 * 1/2016 Cahoon ..... A47K 11/04 4/460
2017/0055789 A1 * 3/2017 Rife ..... A61G 7/1007
2018/0125307 A1 * 5/2018 Jackson ..... A47K 17/00
2020/0015635 A1 * 1/2020 Racanelli ..... A61G 5/1002

* cited by examiner

*Primary Examiner* — William V Gilbert
(74) *Attorney, Agent, or Firm* — Mark F. Smith; Smith Bradenburg Ltd.

(57) ABSTRACT

A shower chair that is easy to assemble, relatively lightweight in construction making it easy to lift into and out of a shower, is rust resistant, and is easy to clean and reduces the likelihood of residue buildup thereby minimizing potential health concerns. The chair is formed such that it minimizes ridges and crevices and includes rounded seams that improves the effectiveness of cleaning the surfaces of the chair and includes antimicrobial materials that reduces the growth of bacteria.

17 Claims, 20 Drawing Sheets

EASY TO CLEAN SHOWER AND COMMODE CHAIR

The present application claims benefit to and incorporates in its entirety by reference the subject matter contained in U.S. provisional patent application No. 62/782,082 filed on Dec. 19, 2018.

BACKGROUND OF THE INVENTION

The subject invention is directed to a new and improved shower and commode chair and more specifically, to a new and improved shower and commode chair that is easy to clean, portable and lightweight and reduces the growth of bacteria particularly in hard to clean areas.

Portable chairs for use in showers and as commode chairs have been developed. Such chairs require cleaning often to prevent health concerns such as the growth of bacteria that can develop along the surface of the chair. Unfortunately, the designs and construction of such chairs often make it difficult to thoroughly clean all of the surfaces of the chair, particularly in areas that are difficult to reach. Accordingly, such chairs are often left unclean after use allowing debris to accumulate or water to remain over a period of time allowing for bacterial to grow creating potential health problems. Particle buildup, such as residue from soap, often cling and buildup such as in areas where two components are positioned in close proximity or mated forming ridges and crevices that promote residue buildup. Three prior art shower chairs are illustrated in FIGS. 1, 2 and 3. As shown, such chairs have numerous fittings and connectors 10 for attaching components together. Unfortunately, the use of such connectors results in formation of ridges and crevices where residual can accumulate and build up. These ridges and crevices are often difficult to reach for cleaning or to effectively clean thereby allowing the growth of mold, mildew and bacteria.

Another problem with conventional chairs for use as portable commodes and for use in showers is that often the connectors that are used to attach components together, such as conventional connectors that connect PVC piping together, often become stressed resulting in the formation of hairline cracks that eventually results in breakage. Such breakage has resulted in users sustaining injury. Further, fittings often have gaps that permit water to penetrate into the chair which can also result in bacterial growth.

Accordingly, it would be desirable to have a shower chair that is easy to assemble, relatively lightweight in construction making it easy to lift into and out of a shower, is rust resistant, and can be effectively cleaned to reduce the likelihood of residue buildup and bacteria growth thereby minimizing potential health concerns.

SUMMARY OF THE INVENTION

The subject invention is a new and novel chair that can be used in a shower or used as a portable commode. The chair is formed from a rust resistant material or a material having a coating that prevents the formation of rust and/or the growth of bacteria. In a preferred embodiment the chair comprises a support structure having first and second spaced apart parallel frames each formed having a horizontal arm support segment that is curved downwardly from the horizontal arm support segment to form elongated front and back legs. The first and second spaced apart parallel frames are connected together by an upper front horizontal brace having a first end that is inserted into the front leg of the first frame forming a connection and a second end that is inserted into the front leg of the second frame forming a connection and by an upper back horizontal brace having a first end that is inserted into the back leg of the first frame forming a connection and a second end that is inserted into the back leg of second frame forming a connection. In a preferred embodiment of the invention the upper front horizontal brace and the upper back horizontal brace operate to support a seat that attaches to the upper front horizontal brace and the upper back horizontal brace.

In a preferred embodiment of the invention the seat is a commode seat that rests on the upper surfaces of the upper front horizontal brace and the upper back horizontal brace.

In another preferred embodiment of the invention the seat is formed from one or more material sheets each having a front end attached to the upper front horizontal brace and a back end attached to the upper back horizontal brace.

In another preferred embodiment of the invention the chair includes a vertically extending back support.

In another preferred embodiment of the invention the vertically extending back support includes a horizontal upper portion and a first side portion that bends downwardly from the horizontal upper portion and a second side portion that bends downwardly from the horizontal portion. The first side portion is coupled to the back segment of the first parallel frame and the second side portion is coupled to the back segment of the second parallel frame.

In a preferred embodiment of the invention the first side portion is coupled to the back segment of the first parallel frame in a space apart relationship and the second side portion is coupled to the back segment of the second parallel frame in a spaced apart relationship.

In a preferred embodiment of the invention the first and second spaced apart parallel frames are tubular in form and are connected by an lower front horizontal brace such that a first end is inserted into the front leg of the first frame forming a connection and a second end is inserted into the front leg of the second frame forming a connection wherein the front legs of the first frame and the second frame each have an internal metallic connector that mates with the ends of the lower front horizontal brace and the ends and the internal metallic connectors are held in position by corresponding threaded bolts extending vertically though the surface of the front ends and engage with the ends of the lower front horizontal brace and the internal metallic connectors.

In another preferred embodiment of the invention the first and second spaced apart parallel frames are tubular in form and are connected by an lower back horizontal brace such that a first end that is inserted into the back leg of the first frame forming a connection and a second end is inserted into the back leg of the second frame forming a connection and wherein the back legs of the first frame and the second frame each have an internal metallic connector that mates with the ends of the lower back horizontal brace and the ends and the internal metallic connectors are held in position by corresponding threaded bolts extending vertically though the surface of the back ends and engage with the ends of the lower back horizontal brace and the internal metallic connectors.

In a preferred embodiment of the invention the threaded bolts are formed from antimicrobial material such as, but not limited to, a noble metal.

In a preferred embodiment of the invention each connection has a generally rounded seam.

In a preferred embodiment of the invention one or more of the connections include a water-resistant seal forming a generally rounded seam.

In a preferred embodiment of the invention one or more of the connections have a water-resistant seal having an antimicrobial material along and/or within the seal.

In a preferred embodiment of the invention one or more of the connections include a foil having an antimicrobial material, such as but not limited to, a noble metal.

In another preferred embodiment of the invention the front and back legs have lower open ends that mate with wheels or rollers that operate to permit the chair to roll across a surface.

In another preferred embodiment of the invention the legs are vertically adjustable to permit the seat to be vertically adjusted.

These and other features, aspects, and advantages of the present invention will become better understood with regard to the following description, appended claims, and accompanying drawings.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

The subject invention is a new and novel chair that can be used in a shower or used as a portable commode. Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims. Therefore, specific structural and functional details disclosed herein are not to be interpreted as limiting, but merely as a basis for the claims and as a representative basis for teaching one skilled in the art to variously employ the present invention in virtually any appropriately detailed structure.

As used herein the terms "upward" or "upwardly" refers to the direction away from the ground or floor; the terms "downward" or "downwardly" refers to the direction towards the ground or floor; the term "lower" refers to a position closest to the ground or floor; the term "upper" refers to a position furthest from the ground or floor; the terms "vertical" or "vertically" refers to a plane generally perpendicular or normal to the ground or floor; and the term "horizontal" or "horizontally" refers to a plane generally parallel to the ground or floor that the chair is resting on. As used herein the terms "forwardly" or "forward" refers to the direction facing away from the front of the chair and the terms "rearwardly" or "reward" refers to the direction facing towards the chair.

Figure 1:
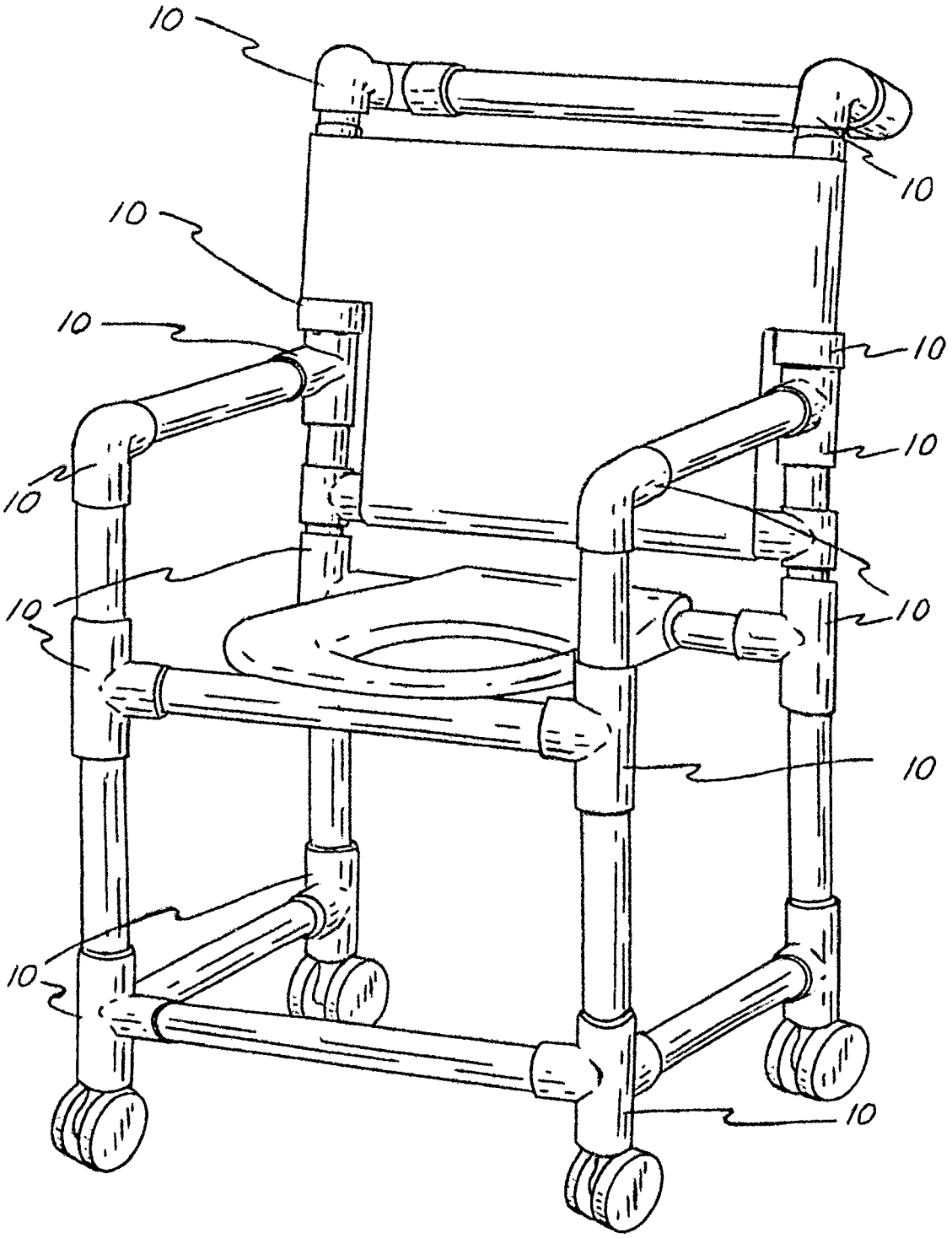
FIG-1 PRIOR ART
FIG. 1 is an image of a prior art chair for use in showers or as a portable commode showing a plurality of connectors for attaching various components together, wherein the connectors form crevices or ridges that operate to accumulate debris, such as soap residue, and makes cleaning difficult that can result in bacteria growth and such connectors can become stressed over time resulting in hairline cracks that can eventually result in breakage.
Figure 2:
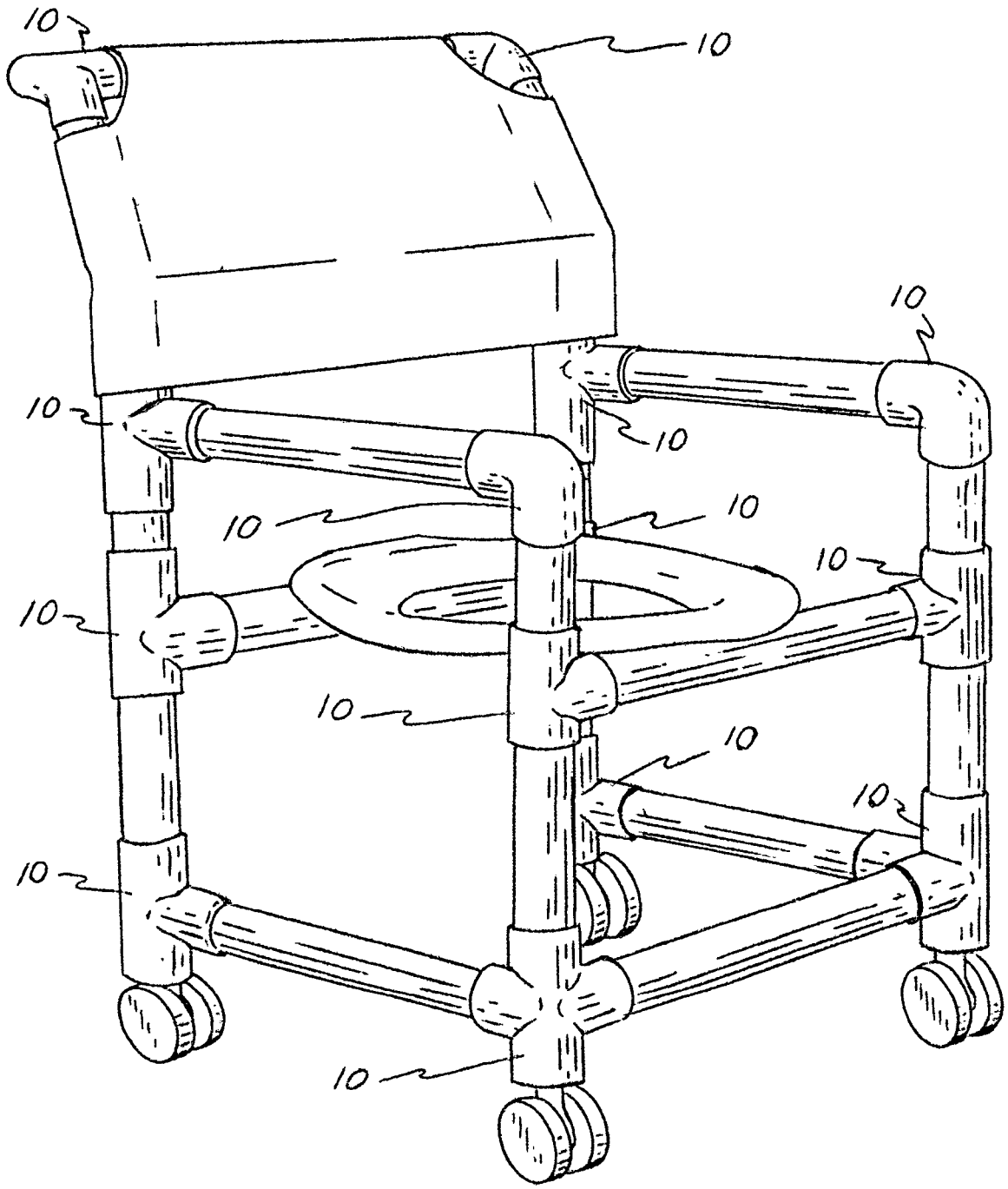
FIG·2 PRIOR ART
FIG. 2 is an image of another prior art chair for use in showers or for use as a portable commode showing a plurality of connectors for attaching various components together, wherein the connectors form crevices or ridges that operate to accumulate debris, such as soap residue, and makes cleaning difficult that can result in bacteria growth and such connectors can become stressed over time resulting in hairline cracks that can eventually result in breakage.
Figure 3:
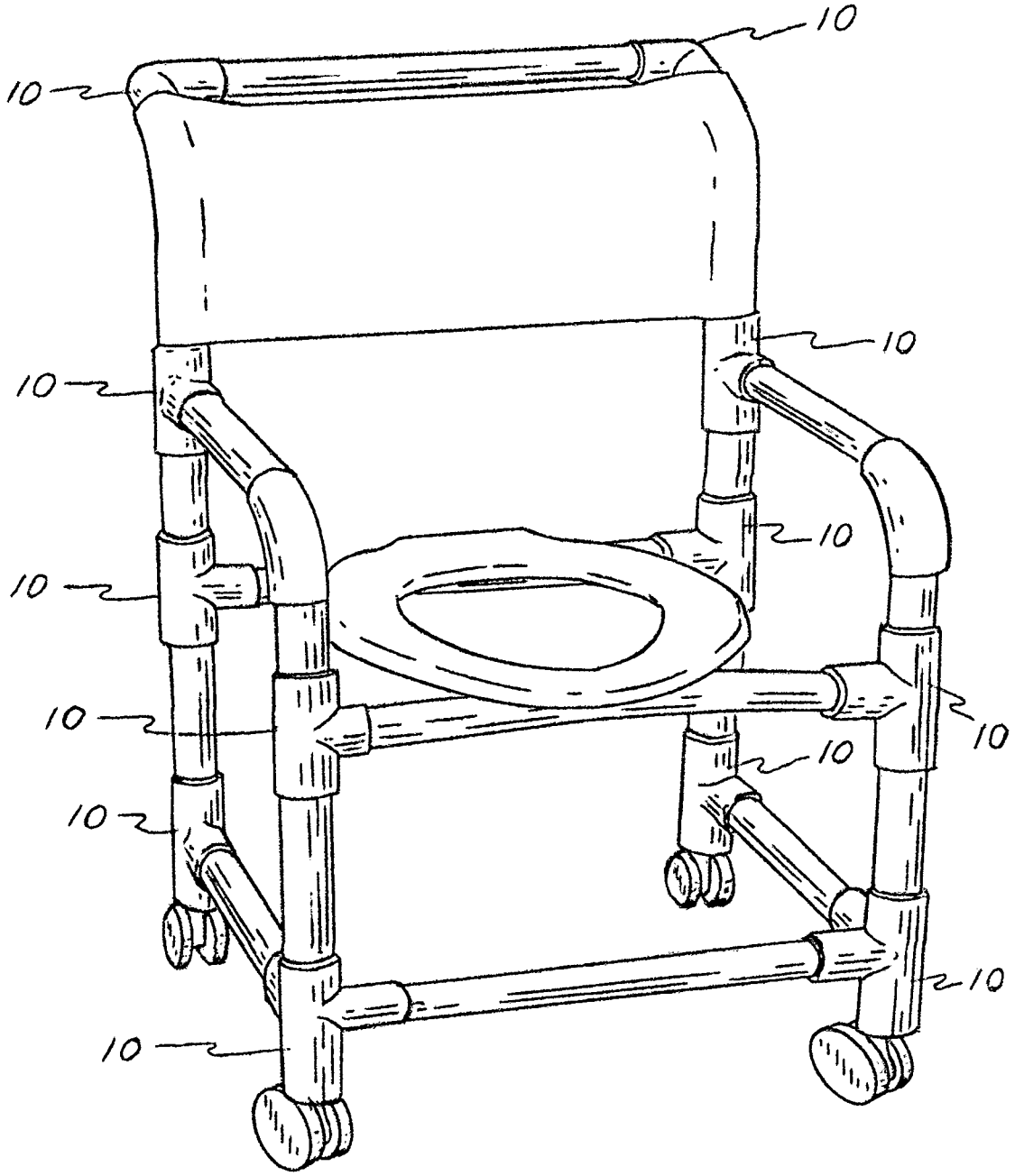
FIG. 3 PRIOR ART
FIG. 3 is an image of another prior art chair for use in showers or for use as a portable commode showing a plurality of connectors for attaching various components together, wherein the connectors for form corners or ridges that operate to accumulate debris, such as soap residue, and makes cleaning difficult that can result in bacteria growth and such connectors can become stressed over time resulting in hairline cracks that can eventually result in breakage.
Figure 4:
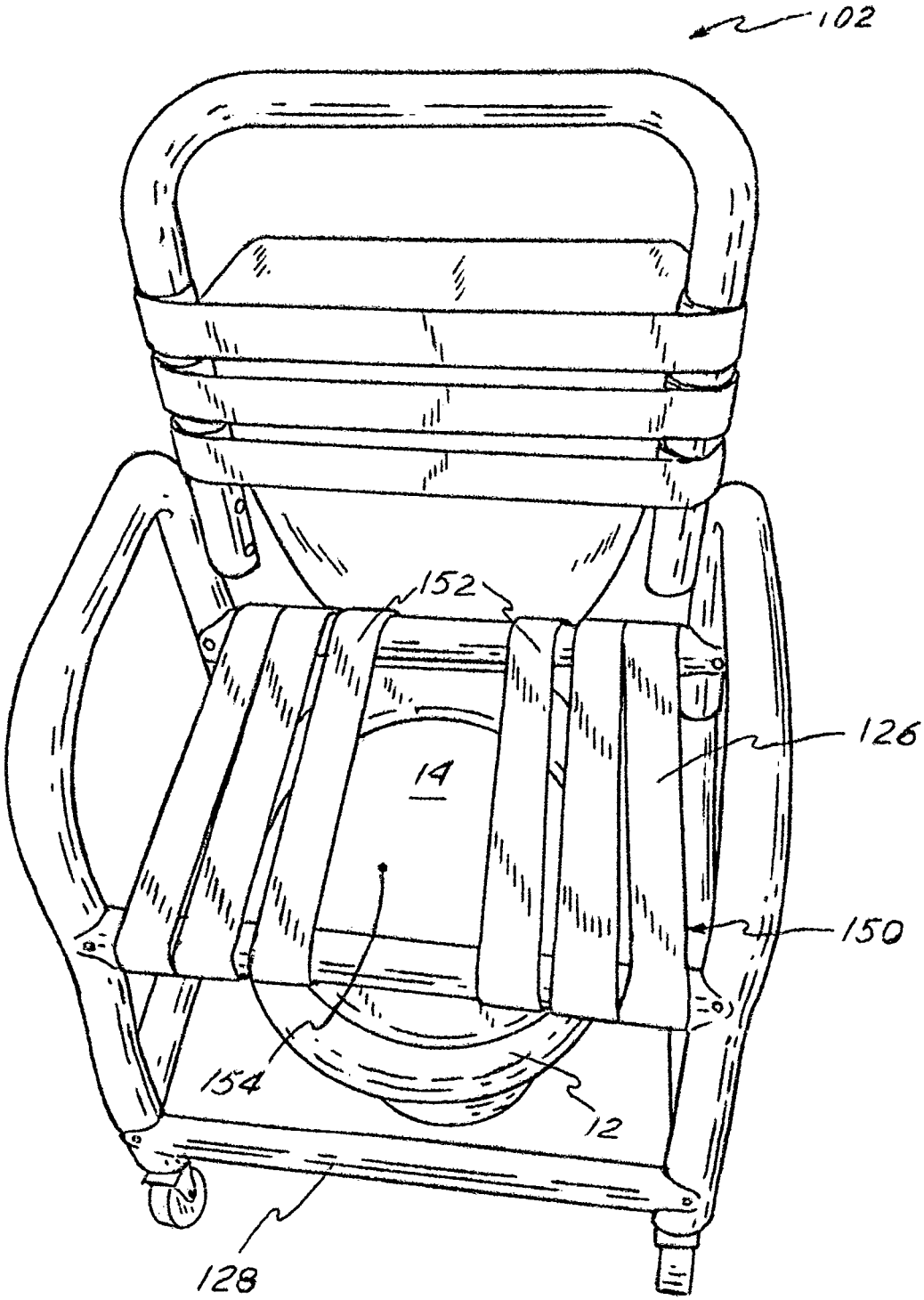
FIG. 4 is an image of a preferred embodiment of the chair of the subject invention showing the chair positioned over a standard commode and having first and second frames connected together by an upper front brace, a lower front brace, an upper back brace and having an upper back support and a seat supported by the upper front brace and the upper back brace.
Figure 7:
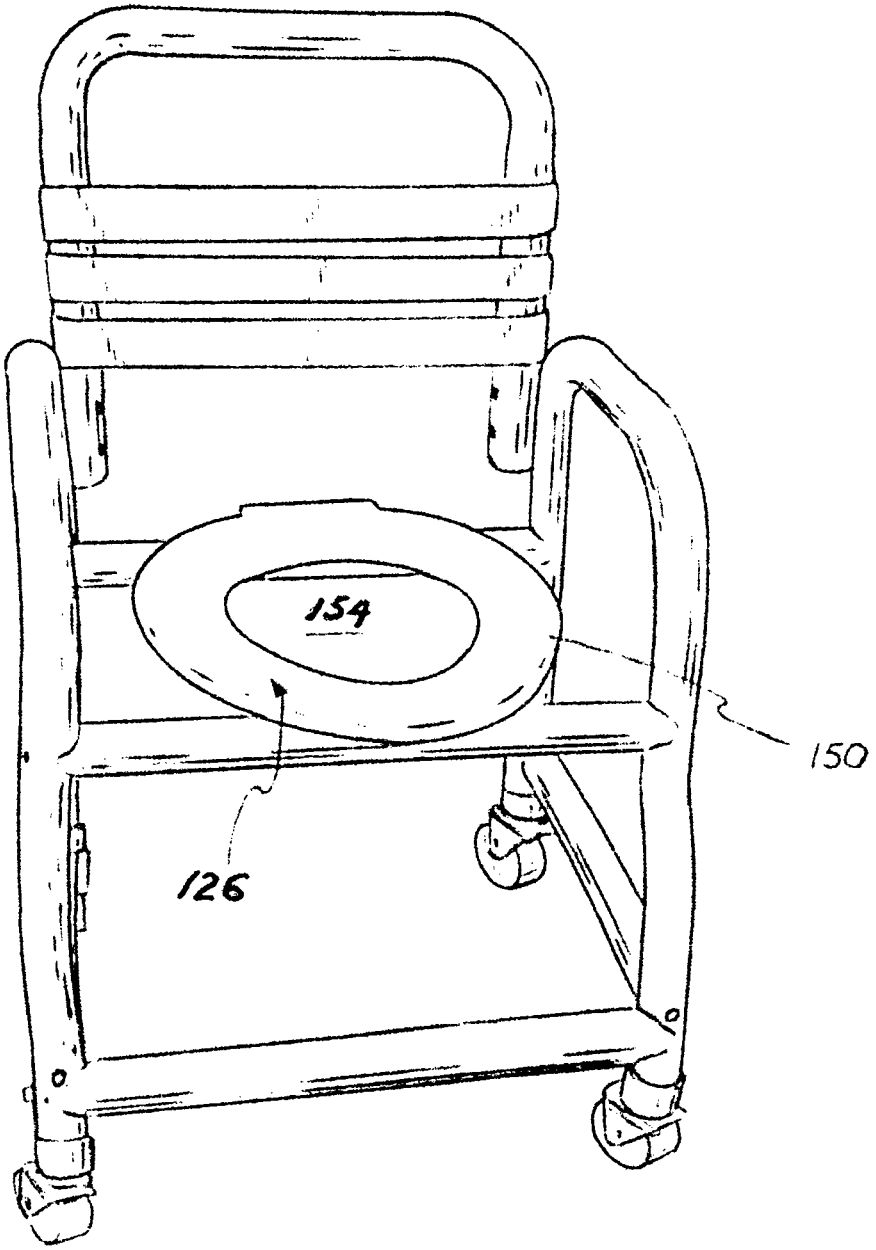
FIG. 7 is an image of another preferred embodiment of the invention showing the chair of the subject invention having a back support and another conventional seat without a commode pail attached.
Figure 8:
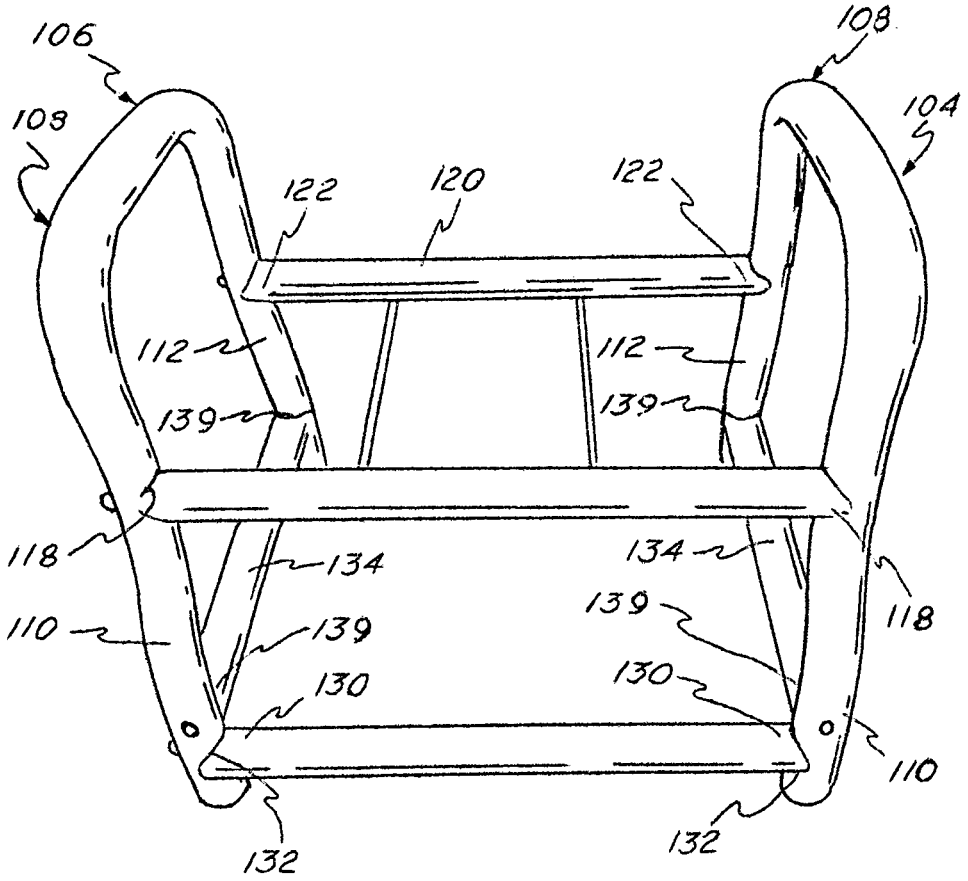
FIG. 8 is an image of the support structure of the chair of the subject invention showing the support structure without a back support and seat.
Figure 9:
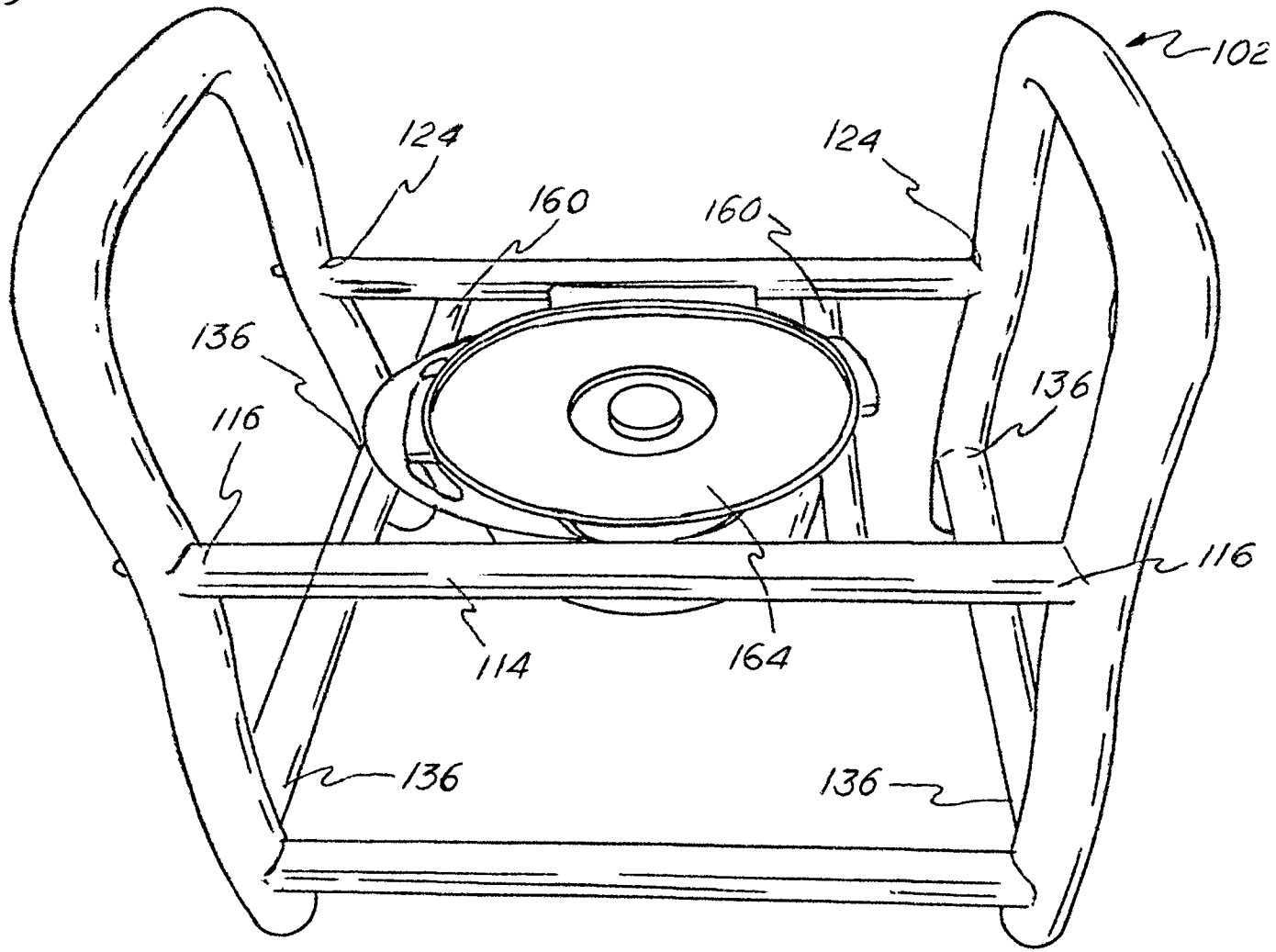
FIG. 9 is an image of the support structure of the chair of the subject invention showing a commode pail attached thereto.
Figure 10:
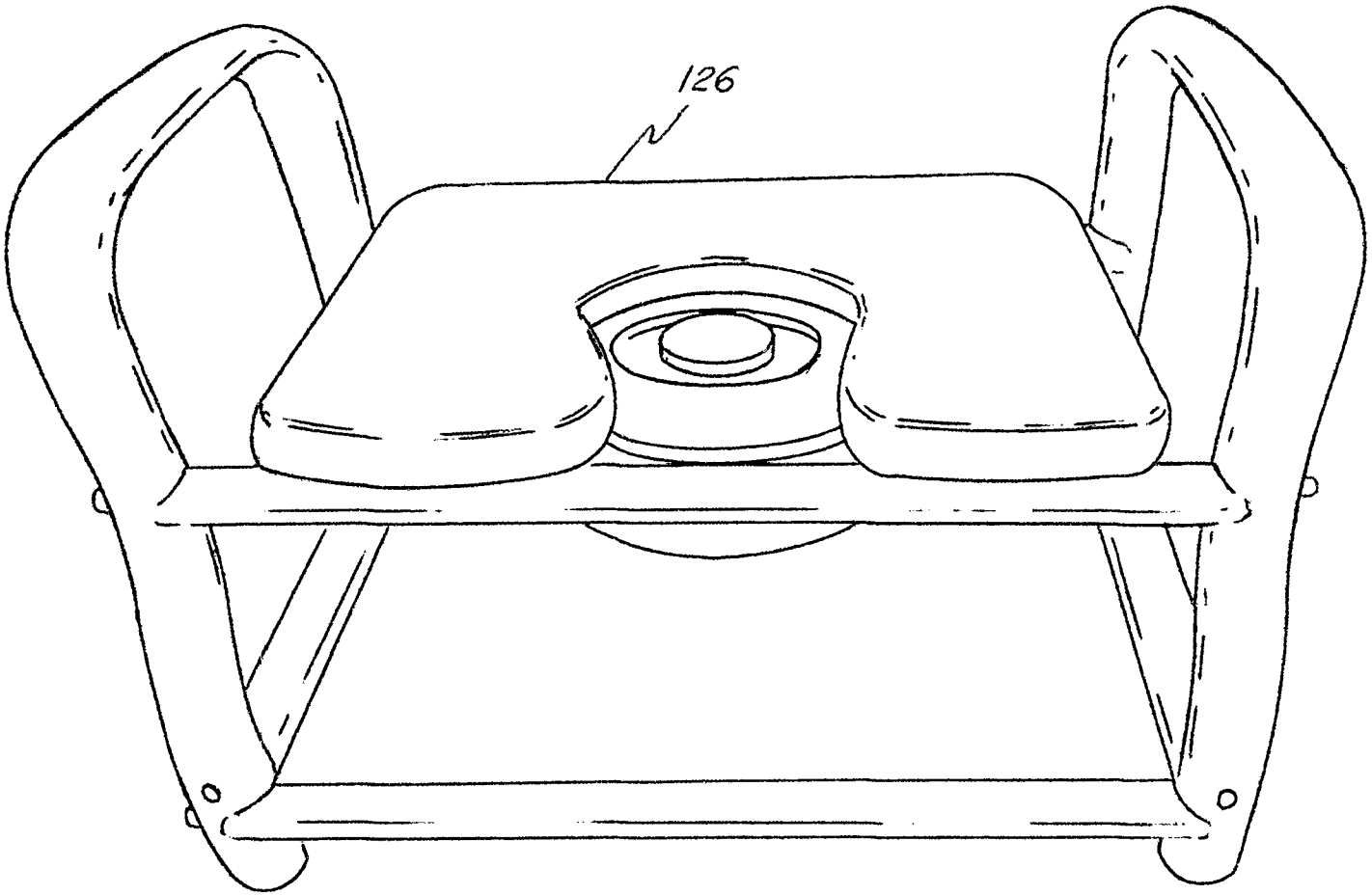
FIG. 10 is an image of the support structure of FIG. 9 showing a commode seat positioned on the support structure.
Figure 19:
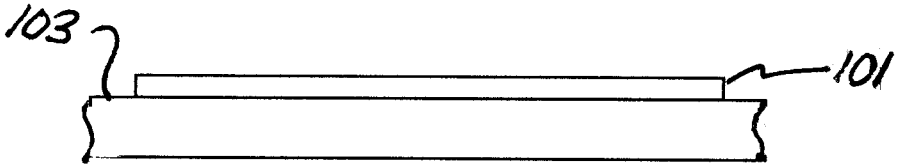
FIG. 19 is a schematic illustration showing a connection of a preferred embodiment of the chair of the subject invention showing a water-resistant seal with an antimicrobial material covering and/or within the seal.

Referring to FIGS. 4, 5, 8 and 9, the easy to clean shower and commode chair 100 of the invention is shown with a support structure 102 having a first and second spaced apart parallel frames 104, 106, respectively. Preferably, the chair and/or one or more of the various components forming the support structure are formed from a polyvinyl chloride material (PVC or CPVC) hollow tubing thereby making the chair inexpensive to manufacture, relatively light weight (such that it can be easily lifted by an individual), and does not rust or react with water. It should be understood, however, other materials, such as a metallic material having a rust resistant and/or bacterial resistant coating 101 (FIG. 19) along its outer surface 103 of the chair 100 (FIG. 19) or formed from a FDA-approved plastic, that are easy to clean, light weight, relatively inexpensive and can support the weight of an individual can also be utilized. In a preferred embodiment, the PVC or CPVC material can be formed with a conventional antimicrobial agent thereby making the chair resistant to the growth of various types of bacteria. The first and second spaced apart parallel frames 104, 106 each include a horizontal arm support segment 108 that curves downwardly to form elongated front and back legs 110, 112 respectively. The first and second spaced apart parallel frames 104, 106 are connected together by an upper front horizontal brace 114 having ends 116 that are inserted into the front legs 110 forming connections 118 with the first and second spaced apart parallel frames 104, 106 and by an upper back horizontal brace 120 having ends 122 that are inserted into corresponding back leg 112 of the first and second spaced apart parallel frames 104, 106 forming connections 124. In a preferred embodiment of the invention, the upper front horizontal brace 114 and the upper back horizontal brace 120 operate to support a seat 126 that attaches to the upper front horizontal brace 114 and the upper back horizontal brace 120 (FIGS. 4, 7 and 10).

To increase the rigidity of the chair the first and second spaced apart parallel frames 104, 106 are further connected together by a lower front horizontal brace 128 having ends 130 that are inserted into the front legs 110 forming connections 132 with the first and second spaced apart parallel frames 104, 106. Each spaced apart parallel frame 104, 106 also includes a side rail 134 positioned between and attached to the front leg 110 and the back leg 112 at the ends 136 of the side rail 134 forming connections 139 which together with the lower front horizontal brace 128 and operate to give the chair support structure 102 additional rigidity and reduces damage to the chair resulting from repeated use and stress.

Figure 11:
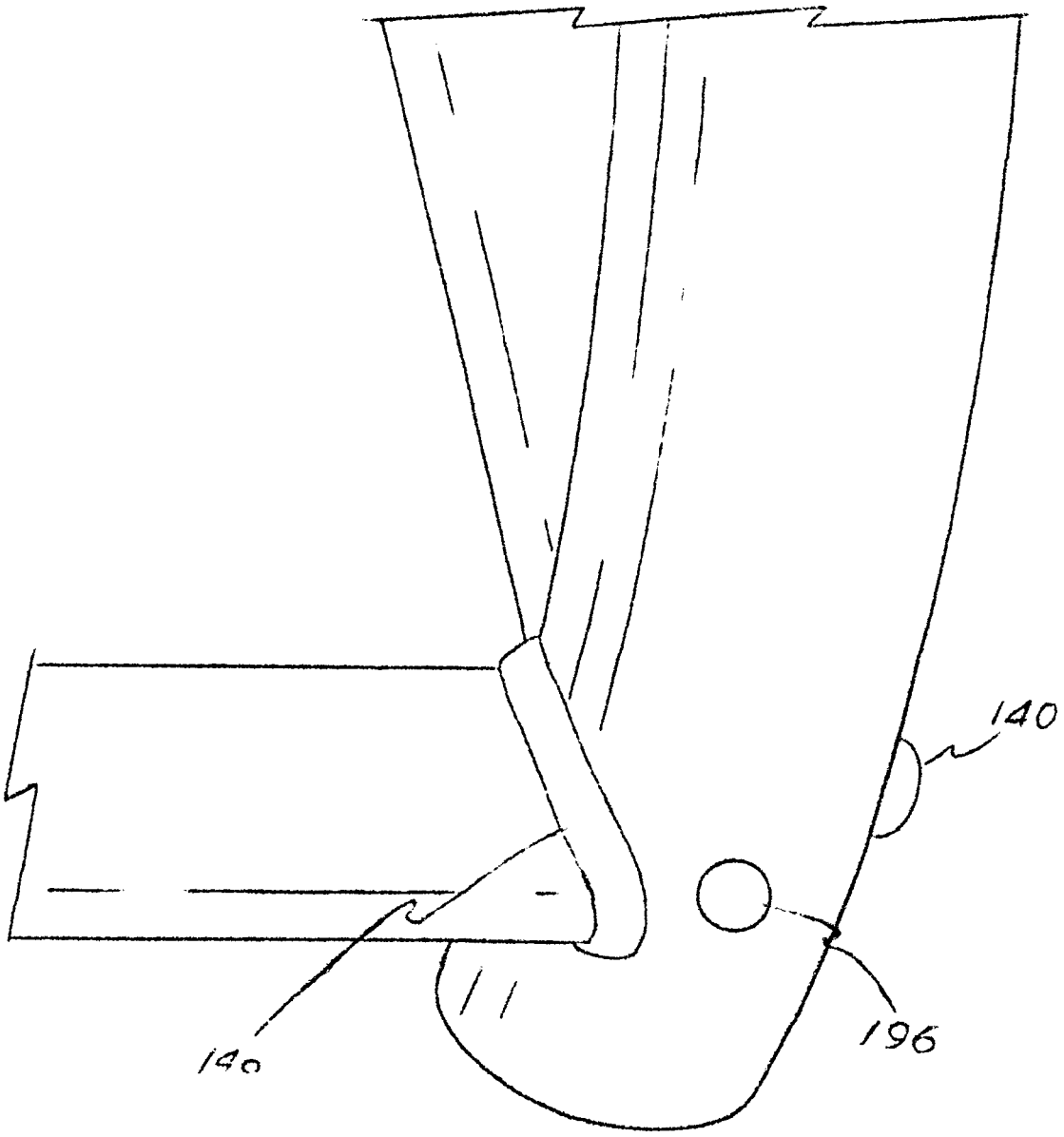
FIG. 11 is an image showing a connection with a rounded seam.
Figure 12:
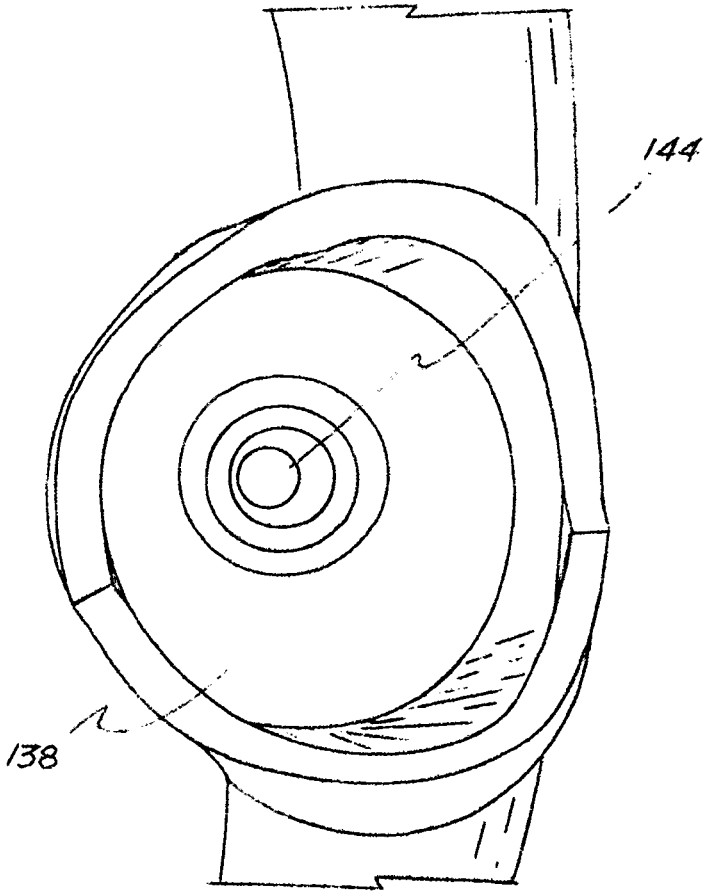
FIG. 12 is an image of an end view of an internal metallic connector positioned within a component for connecting the upper and lower front and back horizontal braces and side rails to the spaced apart parallel frames.
Figure 13:
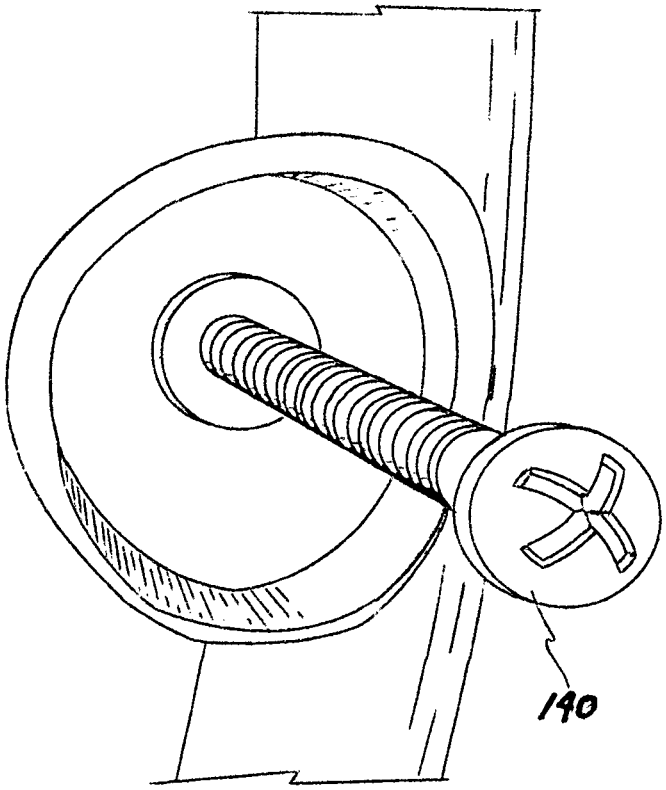
FIG. 13 is an image of an end view of the internal metallic connector of FIG. 12 showing a bolt positioned within a treaded opening in the internal metallic connector.
Figure 14:
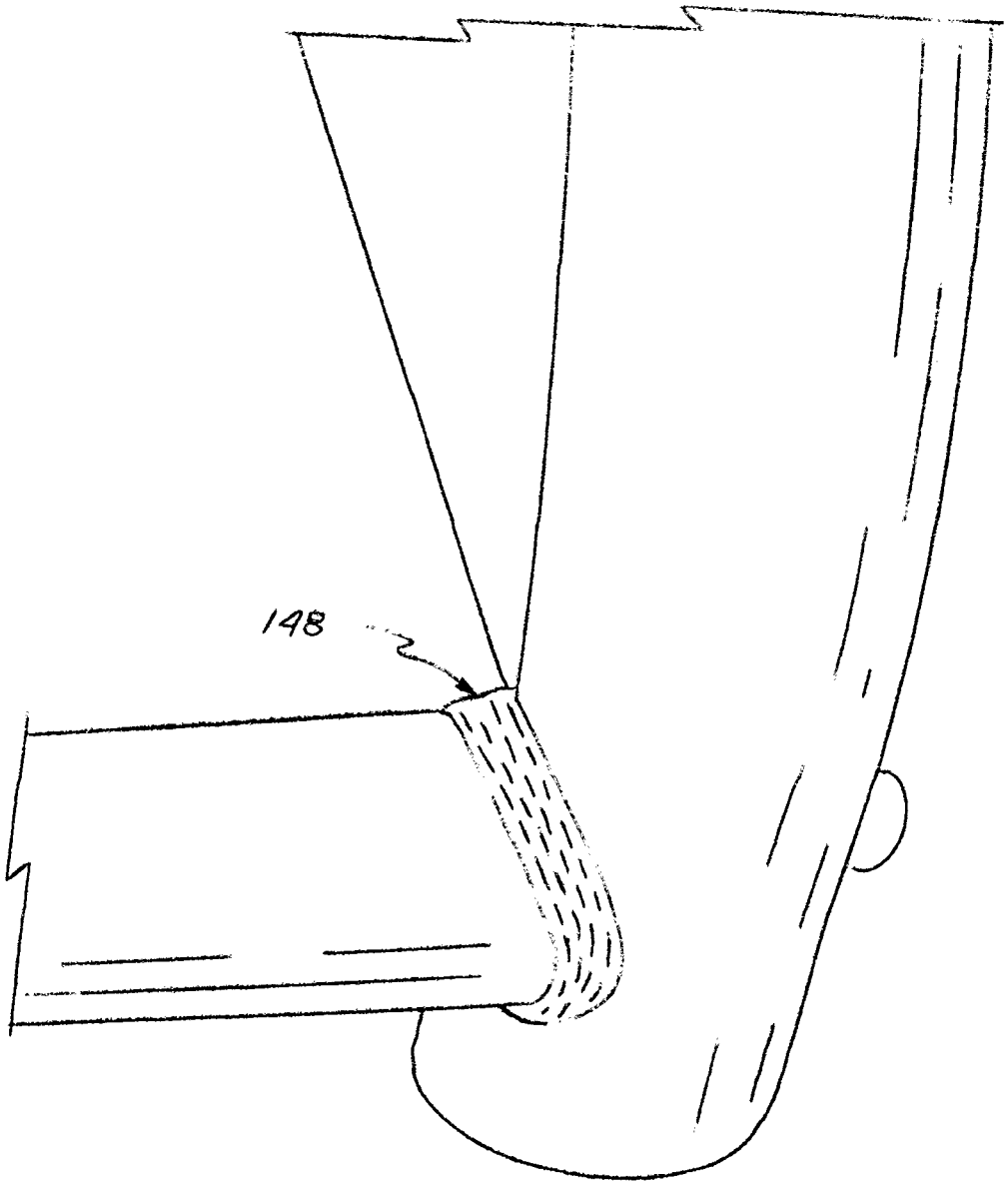
FIG. 14 is an image showing a connection with a water-resistant antimicrobial coating.
Figure 15:
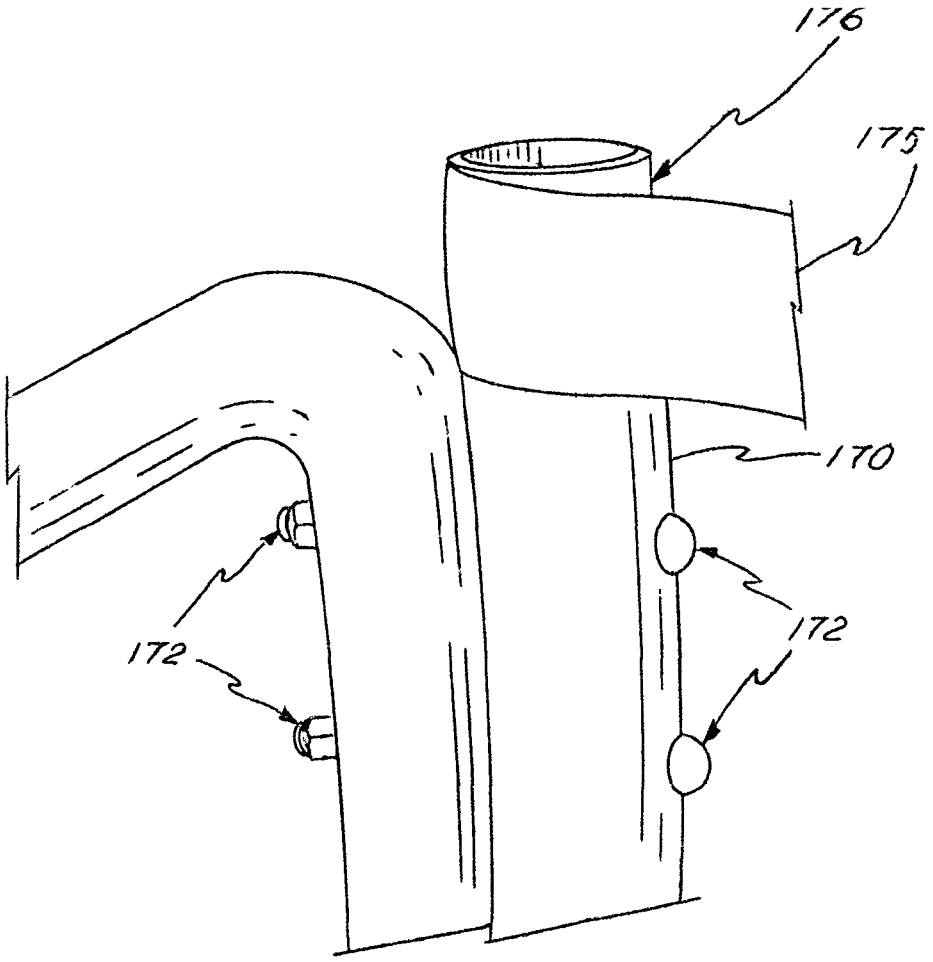
FIG. 15 is an image showing a preferred embodiment of a portion of the back support attached to a parallel frame of the support structure and the attachment of a material sheet to the back support.

As illustrated in FIGS. 11-13, the upper front horizontal brace 114, the upper back horizontal brace 120 and the lower front horizontal brace 128 are attached to the spaced apart parallel frames 104, 106 and side rails 134 are attached to the front legs 110 and the back legs 112 using internal metallic connectors 138 that operate to form rigid connections 118, 124, 132 and 139. As shown, the internal metallic connectors 138 are preferably removably positioned within the upper front horizontal brace 114, the upper back horizontal brace 120 and the lower front horizontal brace 128, and the side rails 134 near the ends 116, 122, 130 and 136 ("connector components"), respectively, by bolts 140 that extend through the surface of the connector components to secure the internal metallic connector in position with the connector components. Preferably, the bolts have a high tensile such as Phillips bolts, Hex bolts, Lay bolts and use Acorn cap nuts and washers. It should be understood that other methods of securing the internal metallic connectors within the connector components can be utilized, such as by means of a frictional fit or by use of an adhesive. The first spaced apart parallel frame 104 and the second spaced apart parallel frame 106 ("frame components") are then connected to the horizontal upper front brace, the horizontal upper back brace, the lower front horizontal brace 128 and the side rails 134 by inserting a bolt 140 through the surface of such frame components that mates with a threaded opening 144 in the internal metallic connectors 138 to rigidly secure the components forming connections 118, 124, 132 and 139. It should be understood that the method of connecting components together as described provides connections that are easy to clean and reduces ridges and crevices where residue will collect or bacterial to grow, Preferably, as illustrated in FIGS. 14, and 15, seams 146 formed along connections 118, 124, 132 and 138 are coated with a conventional water-resistant antimicrobial coating 148 that operates to form a water-resistant antimicrobial rounded seam 146. It should now be understood that such rounded seams eliminate ridges and crevices thereby further reducing the buildup of residue, reduces or eliminates the growth of bacterial, and makes cleaning easier and more effective. In another preferred embodiment, bolts 140 are formed from an antimicrobial material such as a noble metal, such as silver, copper, copper alloys (such as brasses, bronzes, cupronickel, and copper-nickel-zinc) that reduces the likelihood of bacteria forming along the connections.

Referring to FIGS. 4-7, the chair 100 includes a seat 126. As illustrated in FIG. 4, the chair 100 of the subject invention the seat 126 is formed from a material sheet 150. In a preferred embodiment, the material sheet 150 is in the form of a plurality of material strips having a pair of inside strips 152 spaced apart to form an opening 154. The spaced apart parallel frames 104, 106 are spaced apart such that they may accommodate a conventional size commode 12 therebetween with the opening 154 positioned directly over the opening 14 of the commode 12. For a non-limiting example, six material strips can be spread evenly leaving about a 5-inch gap in the center. It should now be understood that the seat may also be formed from a continuous material sheet having an opening that is positioned directly over the opening of the commode. Preferably, the material sheet 150 is formed from polyvinyl chloride but it should now be understood that other materials that can be formed into a sheet and can support the weight of various sized individuals can also be utilized. Preferably, the material sheet is formed with or using a conventional antimicrobial material that reduces the likelihood of bacterial growth. As shown, the material sheet 150 has material ends 156 and 158 that wrap around the upper back horizontal brace 120 and the upper front horizontal brace 114, respectively, and are conventionally secured in place such as by Velcro, bolts, stitching or by plastic pegs.

Figure 5:
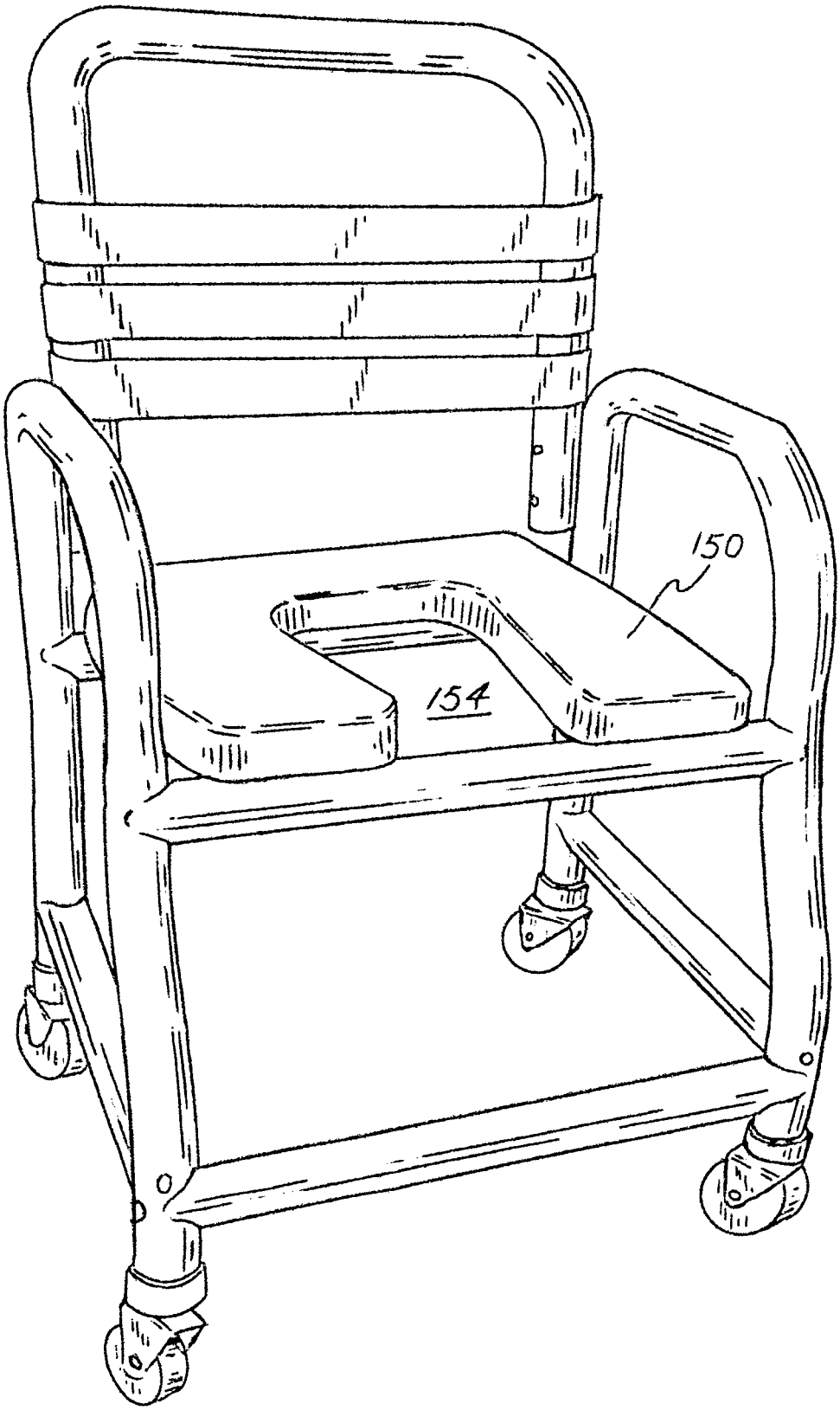
FIG. 5 is an image of another preferred embodiment of the chair of the subject invention showing the chair having back support with a preferred embodiment of a material sheet backing and a seat for use as a portable commode without a commode pail attached.
Figure 6:
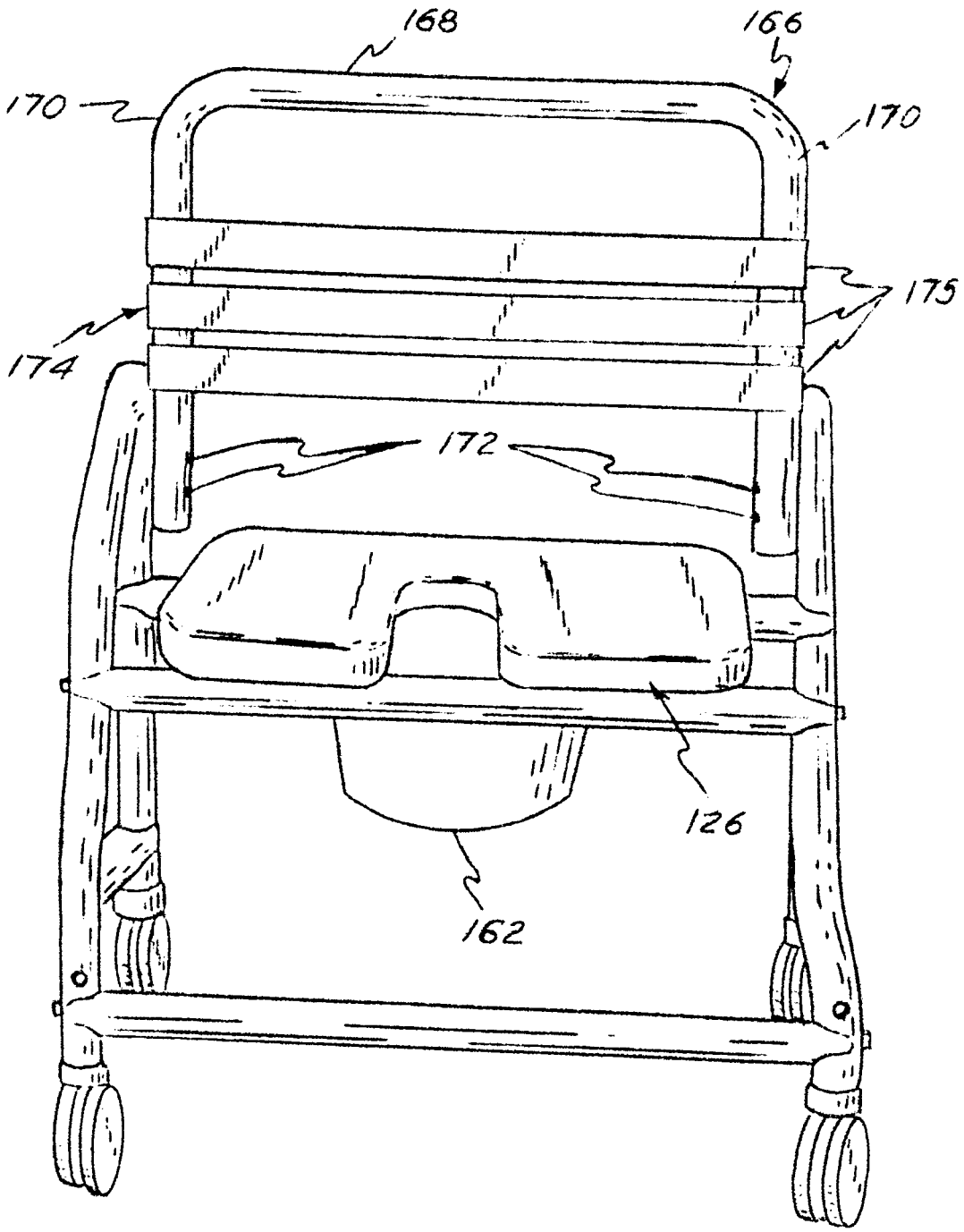
FIG. 6 is an image of another preferred embodiment of the chair of the subject invention showing a seat having a commode pail attached.

In another preferred embodiment of the invention, as illustrated in FIGS. 5, 6 and 7, the seat 126 is formed from a material sheet 150, such as a solid material formed from wood, plastic and other such materials, with or without padding. The material sheet 150 is preferably attached to upper back horizontal brace 120 and the upper front horizontal brace 114 and is conventionally secured in place such as by Velcro, bolts, adhesives, ABS clamps and the like. As shown, the material sheet includes an opening 154 such that it can be positioned directly over the opening 14 of the commode 12. In another preferred embodiment of the invention, as illustrated in FIGS. 6 and 9, the support structure 102 includes a pair of spaced apart struts 160 attached at their ends to the upper front horizontal brace 114 and the upper back horizontal brace 120 for removably mounting a commode pail 162 below the opening 154. Preferably, the commode pail 162 includes a lid 164 (FIG. 9) for placement over the commode pail 162 when not in use. It should now be understood that the commode pail 162 can be removably mounted to the pair of spaced apart struts 160 such that the commode pail can rest on the spaced apart struts or by a conventional mounting system for easy mounting and removal of the commode pail.

Figure 16:
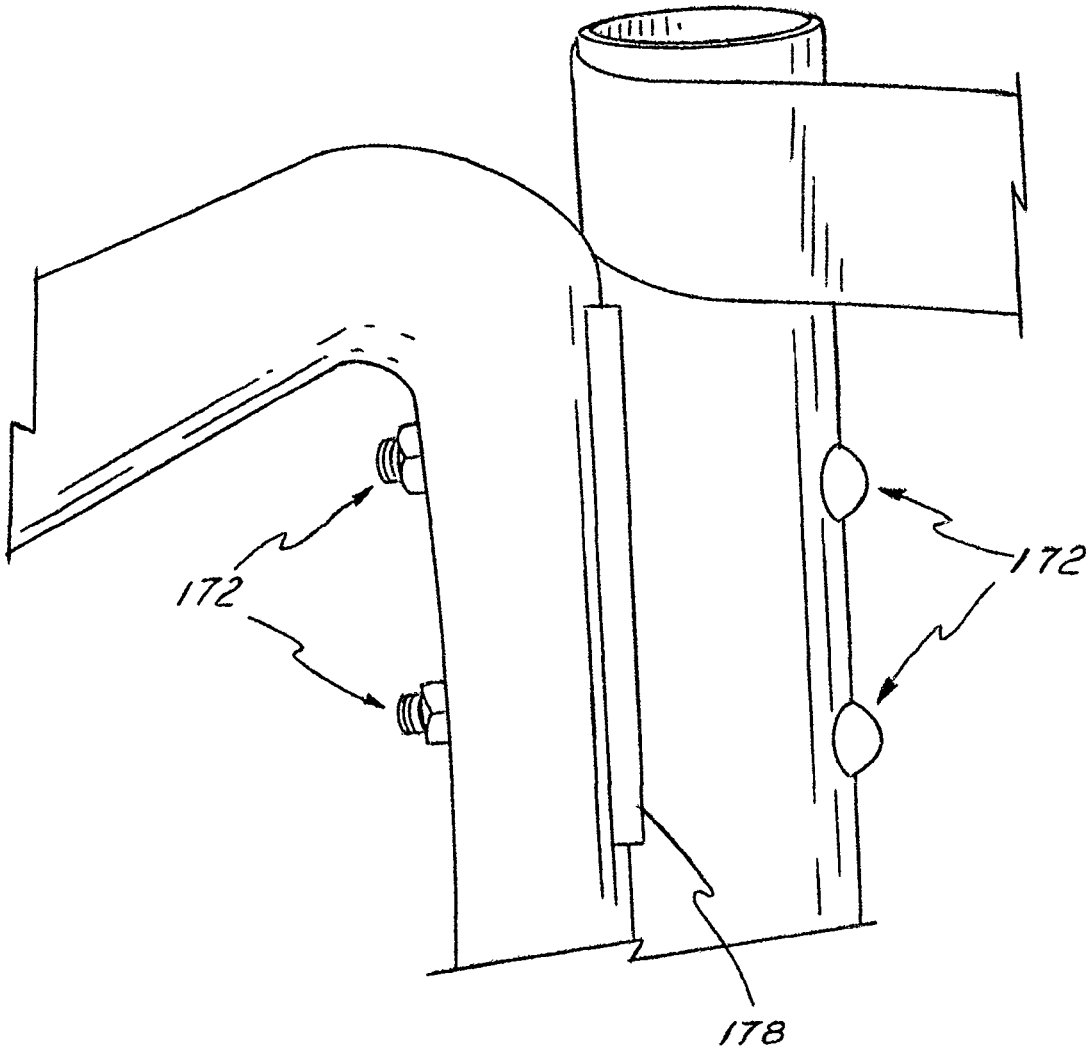
FIG. 16 is an image showing a preferred embodiment of a portion of the back support attached to a parallel frame of the support structure and having a noble metal foil (or an antimicrobial foil) positioned between the back support and the parallel frame to reduce or hinder the growth of bacteria.

Referring to FIGS. 6, 15 and 16, chair 100 includes a back support 166 having a horizontal portion 168 that bends downwardly forming two vertical members 170 that attaches to the first and second spaced apart parallel frames 104, 106, such as by use of bolts 172. A back support member 174, preferably includes a material sheet 175 such as in the form of a plurality of material strips or a mesh material sheet, is attached to the two vertical members 170. It should now be understood that the back support member may also be formed from a continuous material sheet. Preferably, the back support member 174 is formed from polyvinyl chloride but it should now be understood that other materials that can be formed into a sheet and can support back pressure of various sized individuals can also be utilized. In a preferred embodiment of the invention the back support is formed using or with a conventional antimicrobial material to reduce the growth of bacteria. As shown, the back support member 174 has support ends 176 that wrap around the two vertical members 170 and are conventionally secured in place such as by Velcro, bolts, stitching or by plastic pegs. In another preferred embodiment, as shown in FIG. 16, a foil tape 178 formed from an antimicrobial material, such as, but not limited to a noble metal, such as copper or copper alloys (such as brasses, bronzes, cupronickel, copper-nickel-zinc) and the like, is inserted between each vertical member 170 and the spaced apart frames 102, 104, such as by use of an adhesive, that operates to reduce the likelihood of bacteria forming along the intersections between the vertical members and the spaced apart frames. It should also now be understood that bolts 172 may also be formed from an antimicrobial material such as a noble metal (copper or copper alloys, including brasses, bronzes, cupronickel, copper-nickel-zinc) and the like to further reduce the likelihood of bacteria growth.

Figure 18:
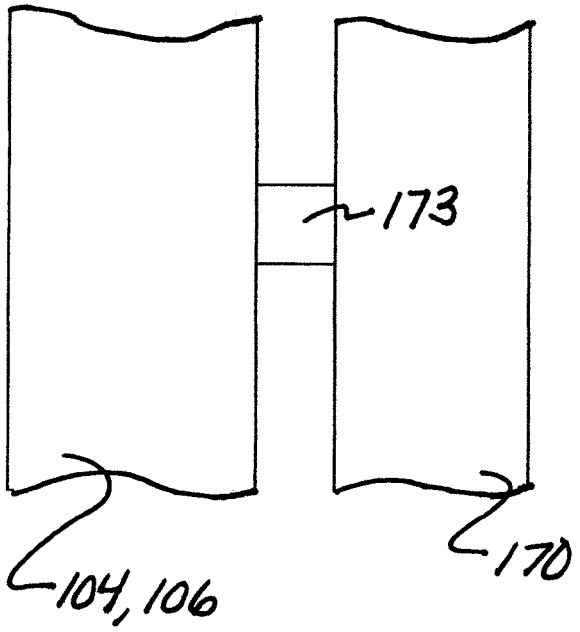
FIG. 18 is a schematic illustration showing a vertical member of the back support that is coupled to a parallel frame in a spaced relationship.

As illustrated in FIG. 18, in another preferred embodiment of the invention the two vertical members 170 are attached to the first and second spaced apart parallel frames 104, 106 in a spaced relationship using a spacer 173. It should now be understood that the spacer 173 operates to permit easy cleaning, such as by use of a wash rag, sponge, cloth and the like, in the areas between the two vertical members and the first and second spaced apart parallel frames.

Figure 17:
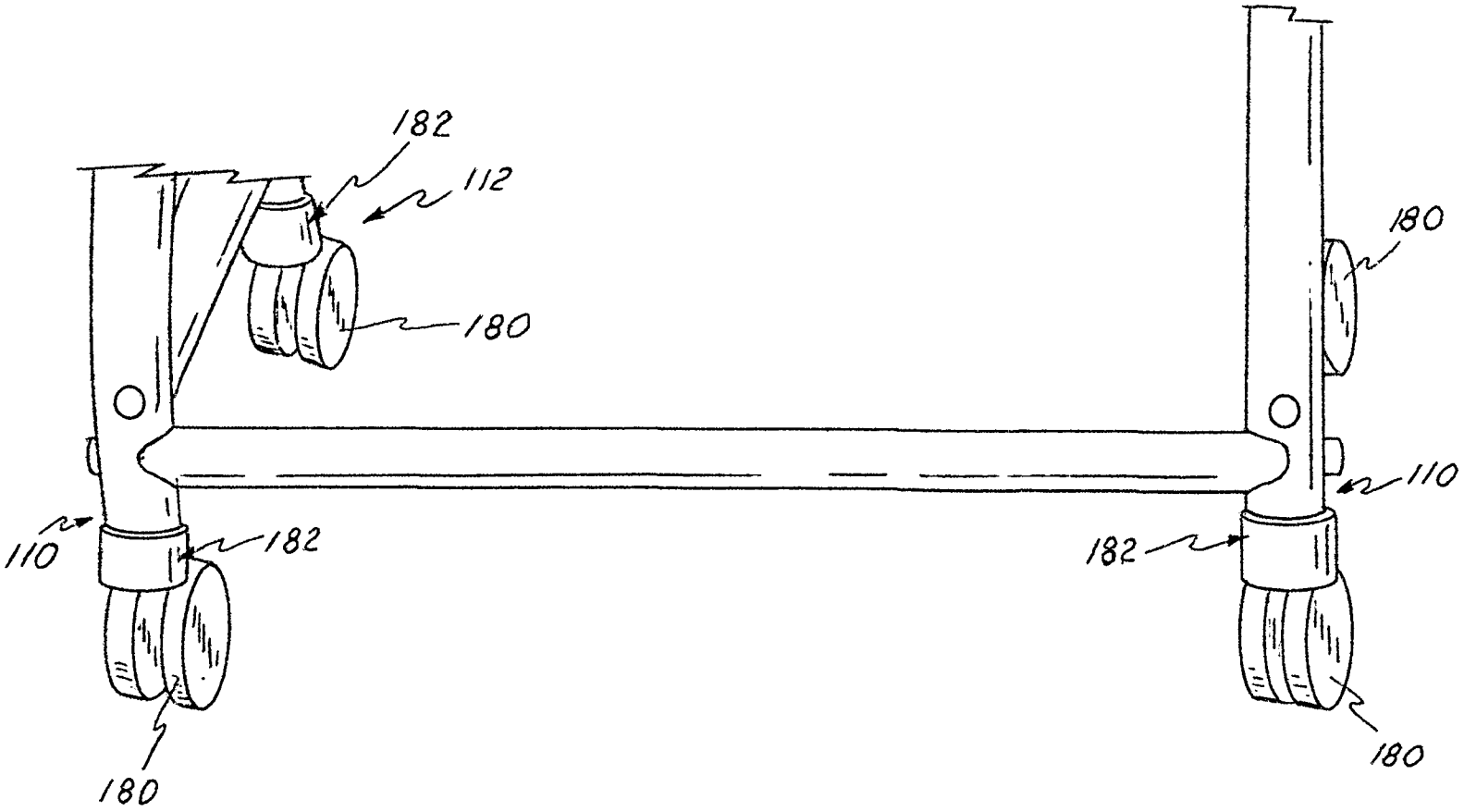
FIG. 17 is an image showing wheels attached to the legs of the first and second spaced apart parallel frames and a lower front brace attached to the front legs and rollers or wheels attached to the legs of the chair.

Referring to FIG. 17, in a preferred embodiment of the invention the front legs 110 and the back legs 112 each include a freely rotating roller or wheel 180 that are conventionally attached to allow the chair 100 to be easily rolled along the ground. It should be understood that the rollers and wheels as used herein refers to various types of rollers, casters (plate and stem), and wheels and preferably are capable of swiveling in a 360 degree rotation to allow the chair to easily maneuver across the ground. In a preferred embodiment the roller or wheel 180 is mounted to a collar 182 that is sized to mate with the end 184 of the legs 110, 112, and secured in place such as by a screw, bolt, frictional fit or by an adhesive and operates to provide additional strength at the connection points.

Figure 20:
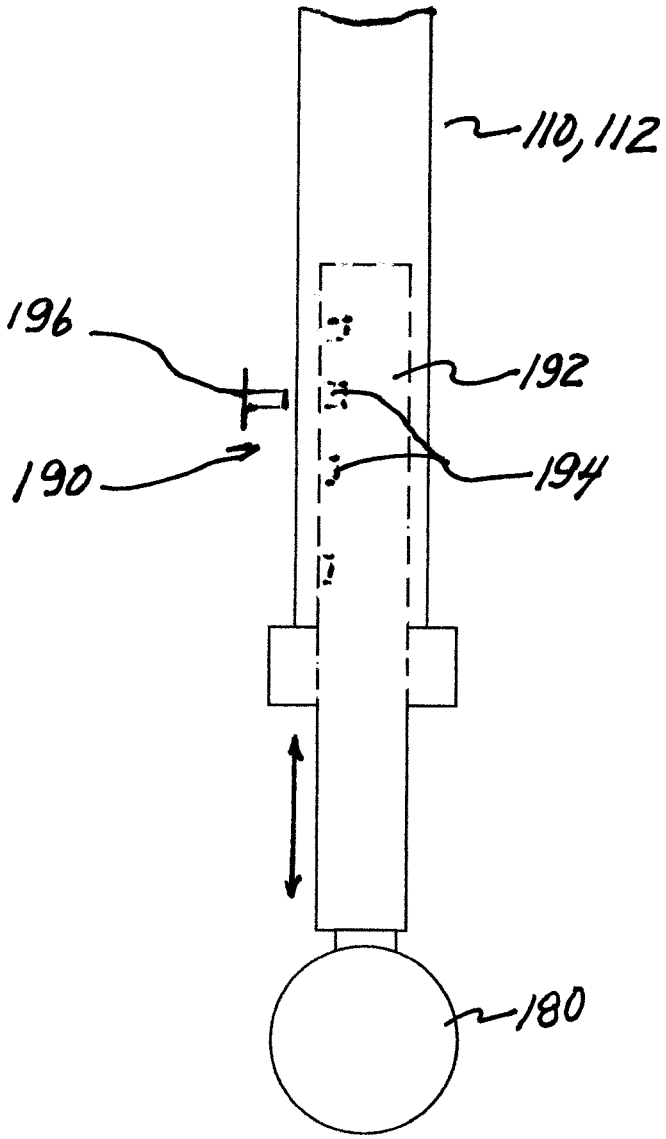
FIG. 20 is a schematic illustration showing a vertical adjustment mechanism that operates to vertically adjust the height of the seat above the ground.

In another preferred embodiment, as illustrated in FIG. 20, the front legs 110 and back legs 112 include a vertical adjustment mechanism 190 that operates to allow a user to vertically adjust the height of the seat 126 above the ground. In a preferred embodiment, for each leg 110, 112, the vertical adjustment mechanism 190 includes a slidable rod 192 telescoping positioned within the leg 110, 112 and preferably includes a plurality of holes 194 longitudinally positioned along the rod 192 that cooperates with a tightening screw 196, positioned within one of the plurality of holes 194 such that when tightened it travels through the desired hole and frictionally locks the leg 110, 112 and the slidable rod 192 in position. The height adjustment mechanism operates such that when released, such as by unscrewing the screw such that it no longer is pressed against the leg 110, 112 the slidable rod 192, it is free to move upwardly along the leg 110, 112 thereby longitudinally shortening the leg 110, 112 or move downwardly along the leg 110, 112 thereby longitudinal lengthening the leg 110, 112. It should be understood that other conventional height adjustment mechanisms can be utilized for adjusting the height of the seat by shortening or lengthening the legs.

It should now be apparent that chair of the subject invention preferably comprises a support structure having first and second spaced apart parallel frames each having a horizontal arm support segment that are curved downwardly from the horizontal arm support segment to form elongated front and back legs. The first and said second spaced apart parallel frames are connected together by an upper front horizontal brace inserted into the front legs forming connections and by an upper back horizontal brace inserted into the back legs forming connections. The upper front horizontal brace and the upper back horizontal brace operate to support a seat that attaches to the upper front horizontal brace and the upper back horizontal brace and the connections each have a rounded seam. In another preferred embodiment of the invention the support structure is formed from or includes an antimicrobial material. In another preferred embodiment of the invention the seat is formed from a plurality of material strips formed with an antimicrobial material. In another preferred embodiment of the invention the chair further comprises a vertically extending back support. Preferably, the vertically extending back support has a horizontal upper portion and a first side portion that bends downwardly from the horizontal upper portion and coupled to the first parallel frame and a second side portion that bends downwardly from the horizontal portion and coupled to the second parallel frame. In another preferred embodiment of the invention the first side portion is coupled to the back segment of the first parallel frame in a space apart relationship and the second side portion is coupled to the back segment of said second parallel frame in a spaced apart relationship. In a preferred embodiment the first and the second spaced apart parallel frames are tubular in form and each have an internal metallic connector for securing the first and the second spaced apart parallel frames with the lower front horizontal brace. Preferably, the connections each include at least one bolt for rigidly securing each connection and wherein each bolt is formed from an antimicrobial metal. In a preferred embodiment each rounded seam includes a water-resistant coating and preferably the water-resistant coating includes an antimicrobial material along the surface of and/or within the coating.

It should now be apparent to one skilled in the art that the new and novel chair that can be used in a shower or used as a portable commode of the subject invention is formed from a material that is strong and light weight such that it is easy to move and sized to be placed over a conventional commode or lifted into and out of a standard shower or bath tub. Further, the various components are fitted together such that the seams formed at their attachment locations do not have any crevices or ridges thereby making cleaning more efficient and reduces or eliminates the buildup of residue, such a soap scum, and the growth of bacteria. In addition, the use of antimicrobial materials, such as noble metals for use as bolts, and in areas between and along component connections further reduces the likelihood of bacteria forming along the connections.

The invention claimed is:

1. A chair comprising:

a support structure having first and second spaced apart parallel frames, each said frame having a horizontal arm support segment that curves downwardly to form elongated front and back legs;

wherein said first and said second spaced apart parallel frames are connected together by an upper front horizontal brace inserted into said front legs and are removably attached to said front legs by internal metallic connectors within said upper front horizontal brace and forming connections having a rounded seam with said front legs, and said frames are further connected by an upper back horizontal brace inserted into said back legs and are removably attached by internal metallic connectors within the upper back horizontal brace and forming connections having a rounded seam with said back legs; and wherein said upper front horizontal brace and said upper back horizontal brace operate to support a seat that attaches to said upper front horizontal brace and said upper back horizontal brace.

2. The chair of claim 1 wherein said support structure is formed with an antimicrobial material.

3. The chair of claim 1 wherein said seat is formed from a plurality of material strips formed with an antimicrobial material.

4. The chair of claim 1 further comprising a vertically extending back support having a first vertical member removably attached to said first parallel frame and a second vertical member removably attached to said second parallel frame.

5. The chair of claim 4 wherein said first vertical member is coupled to said first parallel frame in a spaced apart relationship by use of a spacer effective for allowing cleaning by a sponge or cloth in an area between said first vertical member and said first parallel frame and said second vertical member is coupled to said second parallel frame in a spaced apart relationship by use of a spacer effective for allowing cleaning by a sponge or cloth in an area between said second vertical member and said second parallel frame.

6. The chair of claim 1 further comprising a vertically extending back support having a horizontal portion and a first vertical member that bends downwardly from said horizontal upper portion and coupled to said first parallel frame and a second vertical member that bends downwardly from said horizontal portion and coupled to said second parallel frame.

7. The chair of claim 1 wherein said first and said second spaced apart parallel frames are tubular in form and each said frame has an internal metallic connector for removably securing said first and said second spaced apart parallel frames with a lower front horizontal brace.

8. The chair of claim 1 wherein said first and second spaced apart parallel frames are tubular in form.

9. The chair of claim 1 wherein said first and said second spaced apart parallel frames are tubular in form and wherein each said internal metallic connector includes a bolt that mates with a respective said internal metallic connector for removably securing said first and said second spaced apart parallel frames with said upper back horizontal brace.

10. The chair of claim 1 wherein said spaced apart parallel frames each include a side rail positioned between said front leg and said back leg and wherein each said side rail includes internal metallic connectors that mate with a respective bolt for removably connecting each said side rail to said front leg and said back leg and rigidly securing each said connector to form a connection and wherein each said bolt is formed with an antimicrobial material.

11. The chair of claim 1 wherein each said rounded seam includes a water-resistant coating.

12. The chair of claim 11 wherein said water-resistant coating includes an antimicrobial material along and/or within the coating.

13. The chair of claim 1 wherein at least one of said connections includes an antimicrobial foil.

14. The chair of claim 1 further comprising rollers or wheels that operate to permit the chair to roll across a surface.

15. The chair of claim 1 wherein said front and said back legs are vertically adjustable to permit said seat to be vertically adjusted.

16. A chair comprising:

a support structure having first and second spaced apart parallel frames, each said frame having a horizontal arm support segment and are curved downwardly from said horizontal arm support segment to form elongated front and back legs; and a vertically extending back support having a horizontal upper portion and a first side portion that bends downwardly from said horizontal upper portion and coupled to said first parallel frame, and a second side portion that bends downwardly from said horizontal portion and coupled to said second parallel frame;

wherein said first and said second spaced apart parallel frames are connected together by an upper front horizontal brace inserted into said front legs and are removably attached to said front legs by an internal metallic connector within said upper front horizontal brace and forming connections, and said frames are connected by an upper back horizontal brace inserted into said back legs and are removably attached to said back legs by an internal metallic connector within the back horizontal brace forming connections, each said connection having a rounded seam;

wherein said upper front horizontal brace and said upper back horizontal brace operate to support a seat that attaches to said upper front horizontal brace and said upper back horizontal brace;

wherein each said front and each said back legs include a roller or wheel that operates to permit the chair to roll across a surface and wherein said front and said back legs are vertically adjustable to permit said seat to be vertically adjusted; and wherein each said rounded seam includes a water-resistant antimicrobial coating.

17. The chair of claim 16 wherein at least one of the connections includes an antimicrobial foil.

* * * * *